US009892699B2

(12) United States Patent
Hara

(10) Patent No.: US 9,892,699 B2
(45) Date of Patent: Feb. 13, 2018

(54) DRIVER WITH CONTROL UNIT ACCEPTING INSTRUCTION INFORMATION FOR GIVING INSTRUCTION FOR DISPLAY OF FRAME REGION WHICH SURROUNDS IMAGE REGION

(71) Applicant: SEIKO EPSON CORPORATION, Tokyo (JP)

(72) Inventor: Taro Hara, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 190 days.

(21) Appl. No.: 14/669,999

(22) Filed: Mar. 26, 2015

(65) Prior Publication Data

US 2015/0287163 A1 Oct. 8, 2015

(30) Foreign Application Priority Data

Apr. 4, 2014 (JP) ..... 2014-077739
Jan. 30, 2015 (JP) ..... 2015-016340

(51) Int. Cl.

| | |
|---|---|
| ***G09G 3/36*** | (2006.01) |
| ***G09G 5/18*** | (2006.01) |
| ***G09G 3/20*** | (2006.01) |
| *G09G 5/393* | (2006.01) |

(52) U.S. Cl.

CPC ..... *G09G 3/3618* (2013.01); *G09G 3/20* (2013.01); *G09G 5/18* (2013.01); *G09G 5/393* (2013.01); *G09G 2370/08* (2013.01)

(58) Field of Classification Search

None

See application file for complete search history.

(56) References Cited

U.S. PATENT DOCUMENTS

2002/0008800 A1 1/2002 Matsumoto et al.
2005/0281486 A1* 12/2005 Jeffrey ..... G09G 5/397 382/309
2011/0249009 A1* 10/2011 Nakata ..... G09G 5/026 345/501

FOREIGN PATENT DOCUMENTS

JP 2002-040482 A 2/2002
JP 2002-354229 A 12/2002
JP 2007-295049 A 11/2007

OTHER PUBLICATIONS

"Pixel." Wikipedia. Wikimedia Foundation, Mar. 25, 2014. Web. <https://en.wikipedia.org/w/index.php?title=Pixel&oldid=601134330#Bits_per_pixel>.*

"LCD Classification." Wikipedia. Wikimedia Foundation, Jan. 9, 2013. Web. <https://en.wikipedia.org/w/index.php?title=LCD_classification&oldid=532085288>.*

* cited by examiner

*Primary Examiner* — Vu Nguyen
(74) *Attorney, Agent, or Firm* — Oliff PLC

(57) ABSTRACT

A driver includes a display memory that stores display data, and a control unit that writes the display data in the display memory. The control unit accepts image region information for designating an image region in which an image corresponding to the display data is to be displayed within a display region of a display panel, and instruction information for giving an instruction to display of a frame region which surrounds the image region in the display region, and performs frame write processing for writing given tone data at an address of the display memory corresponding to the frame region, based on the image region information.

12 Claims, 12 Drawing Sheets

(Comparative example)

(Comparative example)

0≦Row address RAD<3 or n-3<Row address RAD≦n

3≦Row address RAD≦n-3

DRIVER WITH CONTROL UNIT ACCEPTING INSTRUCTION INFORMATION FOR GIVING INSTRUCTION FOR DISPLAY OF FRAME REGION WHICH SURROUNDS IMAGE REGION

BACKGROUND

1. Technical Field

The present invention relates to a driver, an electro-optical device, an electronic device, and the like.

2. Related Art

A driver that drives a display panel (e.g., liquid crystal display panel) causes an image corresponding to input display data to be displayed on the display panel by driving a display panel based on this display data. For this kind of image display, a method is available that displays a frame region around an image and improves the appearance of the image displayed within the frame region. The frame region is provided on the upper, lower, left, and right sides of the image so as to have a predetermined width (e.g., several pixels), and is displayed in black or white, for example. In the case of a driver having an embedded display memory, the content stored in the display memory may possibly change due to the influence of noise in an environment with a large amount of noise as in the case of an on-vehicle display or the like. For this reason, for the purpose of noise resistance, the data of the displayed image and the frame region needs to be regularly rewritten (refresh processing). JP-A-2002-354229 is an example of related art.

When displaying the frame region using a simple driver that does not have the display memory, data including frame region data is input from a host controller. On the other hand, the driver having an embedded display memory can accept a refresh processing command and internally write the frame region data in the display memory.

When thus performing the refresh processing in accordance with the command, a problem arises in that instructions given by the host computer are complicated. The host computer gives an instruction to perform the refresh processing by designating addresses of the display memory corresponding to the frame region and issuing the command. For example, if addresses of a starting point and an end point are designated, it corresponds to designation of a rectangle, and accordingly the frame region needs to be divided into four rectangles. That is to say, address designation and command issuance need to be repeated four times, resulting in complicated instructions. Furthermore, while the driver is refreshing one rectangle, the host controller needs to wait for the next command, and accordingly the load on the host controller increases.

SUMMARY

According to some aspects of the invention, a driver, an electro-optical device, an electronic device, and the like can be provided with which instructions of the refresh processing can be simplified.

An aspect of the invention relates to a driver including: a display memory that stores display data; and a control unit that writes the display data in the display memory. The control unit accepts image region information for designating an image region in which an image corresponding to the display data is to be displayed within a display region of a display panel, and instruction information for giving an instruction to display of a frame region which surrounds the image region in the display region, and performs frame write processing for writing given tone data at an address of the display memory corresponding to the frame region, based on the image region information.

According to an aspect of the invention, the given tone data is written at the address of the display memory corresponding to the frame region that surrounds the image region, based on the image region information for designating the image region. The frame region can thereby be specified using the image region information, and instructions of the frame write processing including the refresh processing can be simplified.

In an aspect of the invention, the instruction information may be a command that serves as a trigger for the frame write processing, and the control unit may perform the frame write processing when accepting the command.

The image region information is obtained in advance as information for designating the region in which the display data is to be displayed. In an aspect of the invention, the frame region can be specified using the image region information, and accordingly the frame region does not need to be designated. For this reason, the frame write processing can be performed only by accepting the command serving as a trigger, and instructions of the frame write processing can be simplified.

In an aspect of the invention, an enable terminal may further be included. The instruction information may be an enable signal that is input from the enable terminal, and the control unit may perform the frame write processing at a given interval when the enable signal is active.

In an aspect of the invention, the frame region does not need to be designated, and accordingly the frame write processing can be executed if only a timing of executing the frame write processing is determined. For this reason, the driver can internally execute the frame write processing at given intervals without accepting a command, when the enable signal is active.

In an aspect of the invention, the control unit may perform the frame write processing in a period excluding a period of accepting the display data that is input from outside.

Since two accesses cannot be simultaneously made to the display memory, the frame write processing and the writing of the display data cannot be simultaneously performed. In this regard, according to an aspect of the invention, the frame write processing is not performed while accepting the display data, and accordingly collision between the frame write processing and the writing of the display data can be avoided.

In an aspect of the invention, the image region may be a rectangle, and the image region information may be information for designating two diagonal points of the rectangle.

If two diagonal points are determined, a position of a rectangle is determined, and accordingly the image region can be designated. Furthermore, by designating a rectangle within the display region, the frame region that surrounds the rectangle is automatically designated, and the frame write processing can be performed using the image region information.

In an aspect of the invention, the image region information may be information for designating, as information of the two points, a starting point address and an end point address of a memory region of the display memory corresponding to the rectangle, and the control unit may write the given tone data in a memory region excluding the memory region designated by the starting point address and the end point address.

The address range of the memory region corresponding to the image region is known as a result of designating the starting point address and the end point address as the image region information. Accordingly, the frame write processing can be achieved by writing the given tone data in the memory region outside this address range.

In an aspect of the invention, the control unit may accept the display data and the image region information, write the display data in the display memory, accept the command after writing the display data, and perform the frame write processing.

In an aspect of the invention, the control unit may accept the image region information and the command, perform the frame write processing, accept the display data after performing the frame write processing, and write the display data in the display memory.

Since the frame write processing can be performed at any time after accepting the image region information, the frame write processing can be performed after accepting the display data, or the display data can be accepted after performing the frame write processing.

In an aspect of the invention, a drive circuit may further be included that drives the display panel based on the display data and the given tone data that are written in the display memory, and displays the image and the frame region in the display region.

Another aspect of the invention relates to an electro-optical device including: any one of the above-described drivers; and the display panel.

Still another aspect of the invention relates to an electronic device including any one of the above-described drivers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferable embodiment of the invention will be described in detail. Note that the present embodiment described below is not intended to unduly limit the content of the invention described in the scope of claims, and not all configurations described in the present embodiment are necessarily essential as solving means of the invention.

1. Driver

Figure 1:
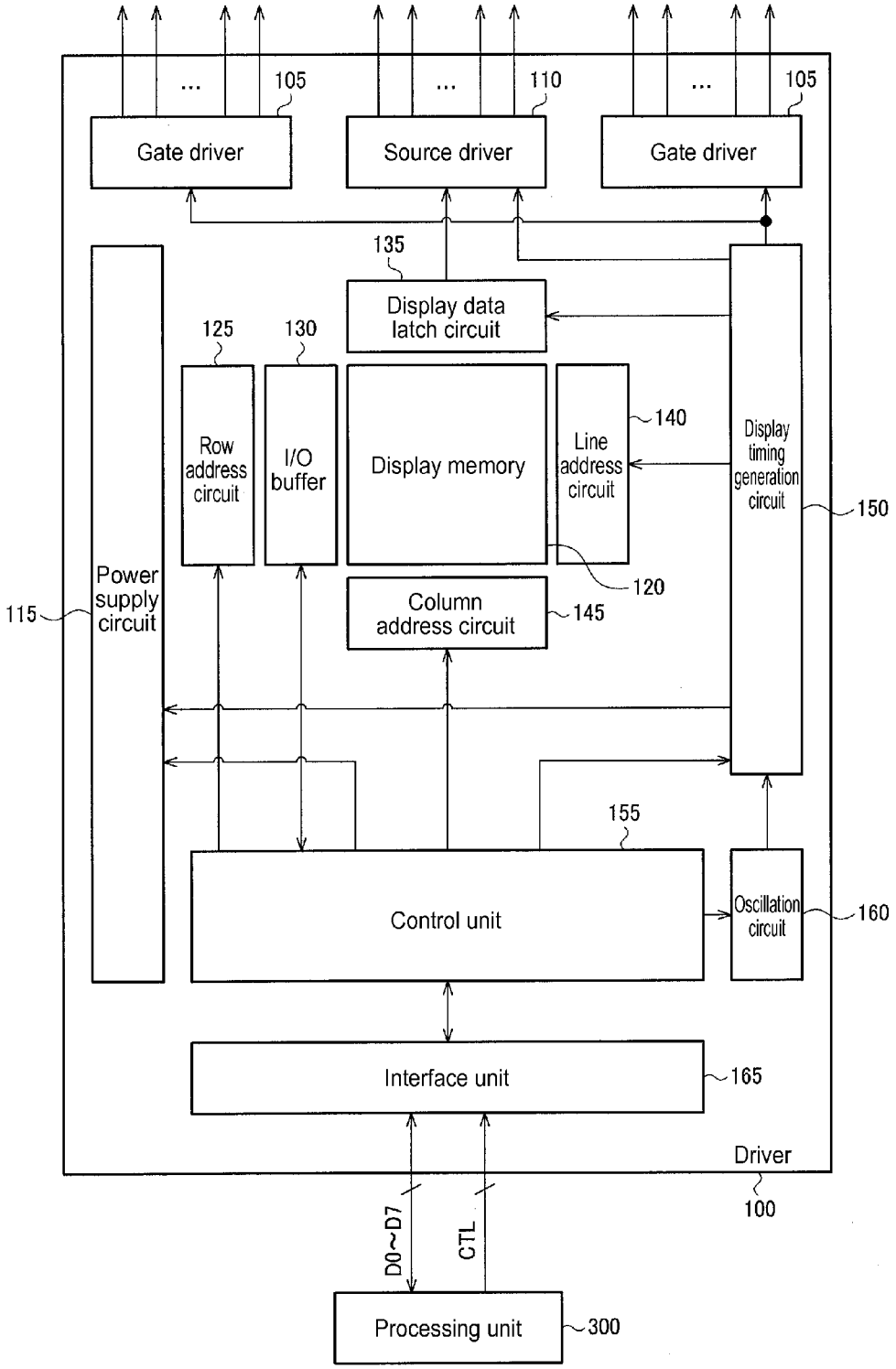
FIG. 1 shows an exemplary configuration of a driver in the present embodiment.

FIG. 1 shows an exemplary configuration of a driver in the present embodiment. A driver 100 includes a gate driver 105, a source driver 110, a power supply circuit 115, a display memory 120, a row address circuit 125, an I/O buffer 130, a display data latch circuit 135, a line address circuit 140, a column address circuit 145, a display timing generation circuit 150, a control unit 155 (control circuit), an oscillator circuit 160, and an interface unit 165.

The driver 100 is configured as an integrated circuit device (IC), for example. A processing unit 300 is constituted by a processor such as an MPU (Micro Processing Unit), and communicates with the driver 100 via data buses D0 to D7 and a control bus CTL.

The interface unit 165 is an interface for communication performed by the processing unit 300 and the control unit 155. The processing unit 300 outputs, for example, a chip select signal (XCS), a write signal (XWR), a read signal (XRD), and an identification signal (AO), via the control bus CTL. In this case, the interface unit 165 performs communication while the chip select signal is active, and latches signals from the data buses D0 to D7 at a rising edge of the write signal. Alternatively, the interface unit 165 outputs signals to the data buses D0 to D7 while the read signal is active. When the identification signal is at a first logical level (e.g., H level), the control unit 155 identifies the signals from the data buses D0 to D7 as data. When the identification signal is at a second logical level (e.g., L level), the control unit 155 identifies signals from the data buses D0 to D7 as commands.

The control unit 155 has a register for storing a command, and a decoder for decoding a command and controls each part of the driver 100 based on a command and display data that are input from the processing unit 300. For example, the control unit 155 controls access to the display memory 120, image display processing, processing for refreshing display, and the like.

The power supply circuit 115 generates a voltage to be used within the driver 100. For example, the power supply circuit 115 generates a power supply voltage for logic circuits (control unit 155 etc.), a power supply voltage for analog circuits (source driver 110 etc.), a power supply voltage for the memory, and the like. The power supply circuit 115 also generates a common voltage, a tone voltage, and the like for driving the display panel.

The display memory 120 is a RAM (Random Access Memory), and stores display data for displaying an image on the display panel. The display memory 120 also stores data (tone data) for displaying a frame region that surrounds an image, as described later. Each pixel of the display panel has a correspond address of the display memory 120. That is to say, display of a pixel can be performed by writing data in the corresponding address.

The I/O buffer 130 is a circuit that inputs and outputs data in a memory cell of the display memory 120, and is constituted by a sense amplifier or the like that inputs and outputs data from a bit line, for example.

The row address circuit 125 and the column address circuit 145 are used when inputting and outputting data between the processing unit 300 and the display memory 120. The row address circuit 125 and the column address circuit 145 decode a row address and a column address to select a bit line and a word line, and select a memory cell of the display memory 120. The data in the selected memory cell is input and output by the I/O buffer 130, and is exchanged between the I/O buffer 130 and the processing unit 300 via the control unit 155 and the interface unit 165.

The line address circuit 140 is a circuit for selecting a memory cell when driving the display panel. The line address circuit 140 selects a row address corresponding to a horizontal scan line, based on a control signal from the display timing generation circuit 150. The data in the memory cell at the selected row address is latched by the display data latch circuit 135. The above row address selection and data latch are sequentially performed during each horizontal scan period.

The display timing generation circuit 150 is a circuit for controlling a timing of driving the display panel. The display panel is driven at a predetermined frame rate, and the display timing generation circuit 150 generates a control signal corresponding to this frame rate.

The oscillator circuit 160 is a circuit that supplies a clock signal to the display timing generation circuit 150, and is constituted by a crystal oscillator circuit or a CR oscillator circuit, for example. The display timing generation circuit 150 controls a drive timing based on this clock signal.

The gate driver 105 and the source driver 110 are drive circuits that drive the display panel. The gate driver 105 selects a gate line of the display panel based on a control signal from the display timing generation circuit 150. The source driver 110 performs D/A conversion on the data latched by the display data latch circuit 135 into a tone voltage, and buffers the tone voltage at a source amplifier to drive a source line of the display panel. This tone voltage is written in a pixel of the selected gate line.

2. Refresh Processing

As a display panel to be driven by the driver 100 in the present embodiment, for example, a liquid crystal display panel of an active matrix type (e.g., TFT liquid crystal) can be assumed. Alternatively, a display panel using a self-light emitting element (e.g., EL element) or the like may be used.

Figure 2:
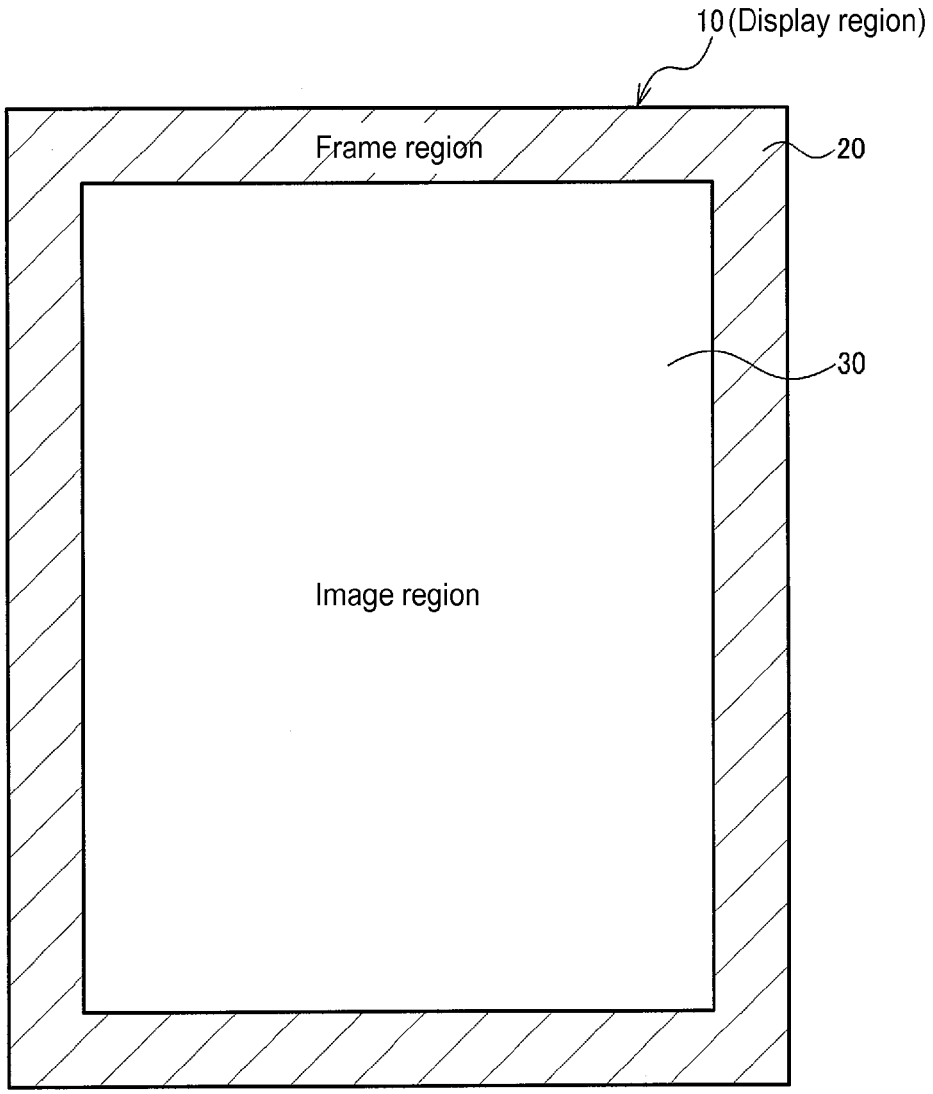
FIG. 2 is a diagram illustrating a display region of a display panel.

FIG. 2 is a diagram illustrating a display region in the display panel. In the display panel, a region of a pixel array that is visible to a user is a display region 10. The display region 10 is constituted by an image region 30 (active area) and a frame region 20 that surrounds the image region 30. In the image region 30, an image corresponding to the display data input from the processing unit 300 is displayed. The frame region 20 is a region filled with a predetermined tone (e.g., black), and is provided in order to improve the image quality (e.g., contrast) of the appearance of the image region 30. The given tone may be set from the processing unit 300, or may be a tone stored in advance within the driver, for example.

Note that the driver 100 in the present embodiment can also perform display without providing the frame region 20. In this case, the entire display region 10 serves as the image region 30.

The frame region 20 and the image region 30 each have a corresponding memory region of the display memory 120. Since the content stored in the display memory 120 may possibly change due to noise, rewrite needs to be regularly performed when continuing the same display. Such rewrite is called refresh processing. For example, in the case of an on-vehicle display, noise easily occurs on a power supply line or the like, and moreover, the purpose of using the on-vehicle display is to continue the same display as in the case of meter display. For this reason, the refresh processing is performed in many cases. Although the refresh processing is performed for both the frame region 20 and the image region 30, the refresh processing is essential in particular for the frame region 20 since it continues the same display.

In the refresh processing for the image region 30, display data is input again from the processing unit 300 to the driver 100, and the driver 100 writes the display data in the display memory 120. On the other hand, in the refresh processing for the frame region 20, the driver 100 accepts a command from the processing unit 300, and internally writes given tone data in the display memory 120.

Figure 3:
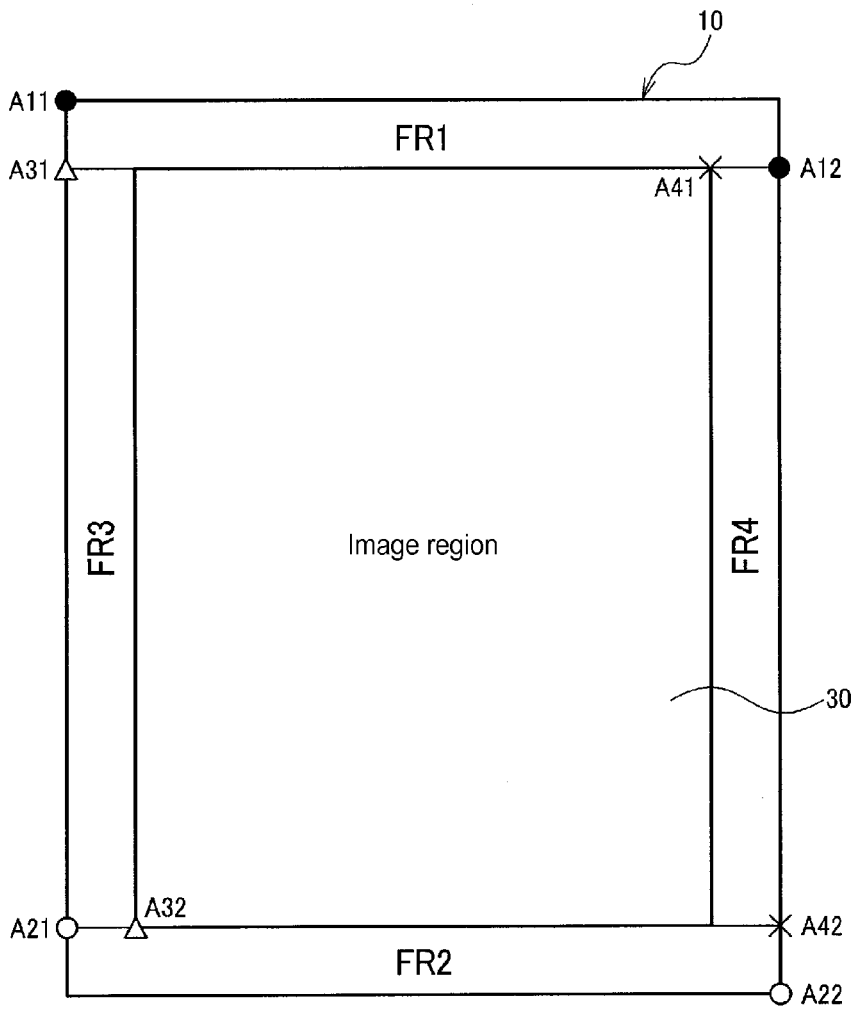
FIG. 3 is a diagram illustrating refresh processing for a frame region in a comparative example.
Figure 4:
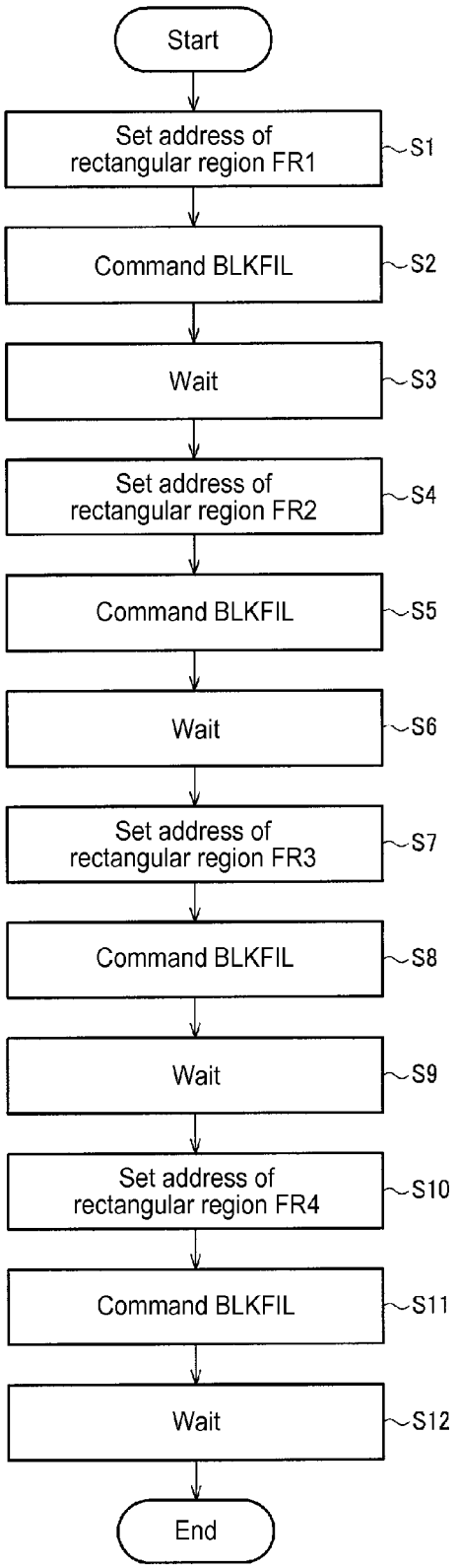
FIG. 4 is a flowchart of refresh processing for a frame region in a comparative example.

The refresh processing for the frame region 20 will be described below. First, a comparative example of the present embodiment will now be described using FIGS. 3 and 4. FIG. 3 shows exemplary division of the frame region 20, and FIG. 4 shows a flowchart of the refresh processing.

As shown in FIG. 3, in the comparative example, the frame region 20 is divided into four rectangular regions, namely rectangular regions FR1 to FR4. As shown in FIG. 4, upon the refresh processing being started, initially, the processing unit 300 designates a starting point A11 and an end point A12 of the rectangular region FR1 (step S1). The starting point A11 and the end point A12 are designated by corresponding addresses of the display memory 120. Next, the processing unit 300 issues a command BLKFIL for giving an instruction of the refresh processing (step S2). The driver 100, upon accepting the command BLKFIL, writes given tone data in a memory region corresponding to the rectangular region FR1, based on the designated addresses. While the driver 100 is writing the tone data, the processing unit 300 waits for the refresh processing for the next rectangular region FR2 (step S3).

The processing similar to the above is repeated for the rectangular regions FR2 to FR4 (steps S4 to S12), and one time of the refresh processing for the frame region 20 ends. The processing unit 300 performs this refresh processing for the frame region 20 together with the refresh processing for the image region 30 at predetermined intervals (e.g., 1-second intervals).

In the above-described comparative example, a starting point and an end point of each rectangular region that are parts of the frame region are designated. Since the starting point and the end point are for designating two diagonal points of a rectangular region, a frame region 20 having a complicated shape cannot be designated at a time. For this reason, it is necessary to divide the frame region 20 into four rectangular regions, namely the rectangular regions FR1 to FR4 and perform the refresh processing for each rectangular region, and a problem arises in that the refresh processing is complicated.

Furthermore, a problem also arises in that the refresh processing takes time due to the wait time, which places a load on the processing unit 300. That is to say, in the case of performing the refresh processing on the image region 30, the display data is input from the processing unit 300, and accordingly the writing in the display memory 120 can be performed at this transfer rate. On the other hand, in the case of the refresh processing for the frame region 20, the display data is not input, and accordingly the writing is performed based on the clock signal generated by the internal oscillator circuit 160. Since this clock signal is for generating a display timing (e.g., approximately 1 MHz), clock rate of the clock signal is lower than the transfer rate of the display data (e.g., approximately 3 MHz), resulting in a long wait time. Furthermore, since the oscillation frequency of the oscillator circuit 160 varies, the wait time becomes excessively long as a result of providing a margin to the wait time.

In the present embodiment, the control unit 155 accepts image region information (e.g., starting point B1 and end point B2 in FIG. 5) for designating the image region 30, and instruction information for giving an instruction to display of the frame region 20, and performs frame write processing for writing given tone data in addresses of the display memory 120 corresponding to the frame region 20, based on the accepted image region information.

Specifically, in order to display the display data in the image region 30, the processing unit 300 designates the image region 30 in advance. That is to say, the information for designating the image region 30 has already been obtained before performing the refresh processing for the frame region 20. In the present embodiment, the frame region 20 is specified using this image region information, and the refresh processing is performed on the specified frame region 20.

The refresh processing can thereby be performed without designating the frame region 20, and the refresh processing can be simplified. That is to say, division of the frame region 20 and address designation as in the comparative example are not necessary, and the frame region 20 can be refreshed only by issuing a command as the instruction information. A wait is not necessary since only one time of command issuance is necessary, and the load on the processing unit 300 can be reduced.

Note that the instruction information is not limited to the command, and need only be information for giving an instruction to start of the refresh processing, information for giving an instruction to turn on/off the refresh processing (e.g., later-described enable signal), or the like.

Display of the frame region 20 regarding which an instruction is given by the instruction information is not limited to re-display by the refresh processing, and also includes a case of first displaying the frame region 20. Similarly, the frame write processing is not limited to the refresh processing either, and also includes a case of first performing writing in a memory region corresponding to the frame region 20.

3. Details of Refresh Processing

Figure 5:
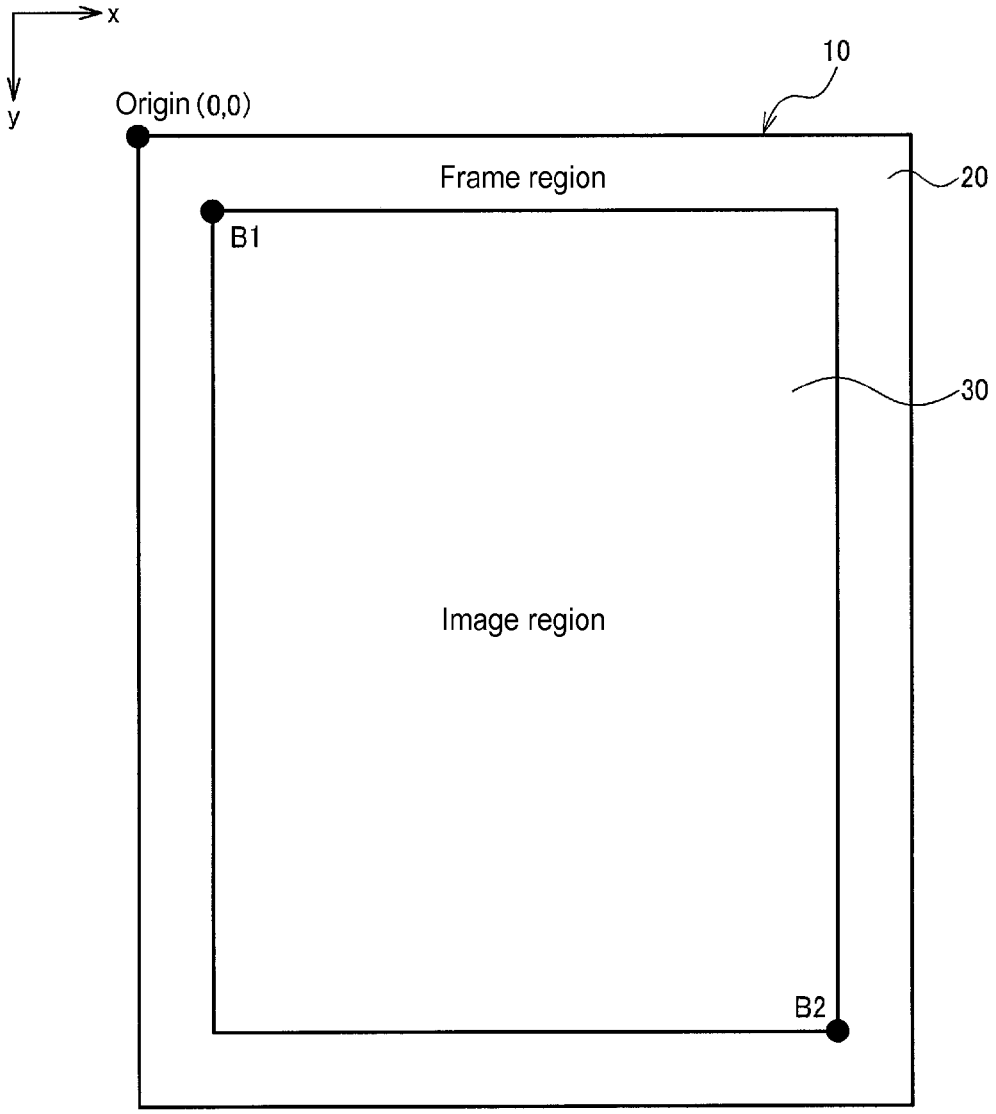
FIG. 5 is a diagram illustrating image region information.

Next, the details of the refresh processing performed in the present embodiment will be described. FIG. 5 is a diagram illustrating the image region information.

As shown in FIG. 5, the image region 30 is a rectangle. The image region information is information for designating two diagonal points of this rectangle, namely points B1 and B2. The points B1 and B2 correspond to the starting point and the end point of the rectangular region, respectively. That is to say, assume that a pixel position within the display region 10 is expressed by the coordinates (x, y), the upper left corner of the display region 10 is an origin (0, 0), a horizontal coordinate extending from left to right takes a value x, and a vertical coordinate extending from above to below takes a value y. In this case, among coordinates (x, y) belonging to the image region 30, a point at which both x and y take smallest values is the starting point B1, and a point at which both x and y take largest values is the end point B2.

The processing unit 300 designates the starting point B1 and the end point B2 by addresses of the display memory 120. For example, on the display memory 120, the horizontal coordinate x corresponds to a column address, a vertical address y corresponds to a row address, and the column address and the row address increase with an increase of the coordinates x and y. That is to say, the starting point B1 is indicated by the smallest column address and row address in the memory region corresponding to the image region 30, and the end point B2 is indicated by the largest column address and row address. The control unit 155 displays an image in the image region 30 by writing the display data in the address range designated by the starting point B1 and the end point B2.

On the other hand, the control unit 155 specifies an address range corresponding to the frame region 20 by excluding the address range designated by the starting point B1 and the end point B2. For example, considering the column address, since the largest value and the smallest value of the column address of the image region 30 are known, the column addresses outside the image region 30 designated thereby are deemed to be column addresses of the frame region 20.

If the starting point B1 and the end point B2 of the image region 30 are thus designated, the largest value and the smallest value of the address are known, and accordingly the addresses of the frame region 20 can be specified by excluding the area of the image region 30 designated by the largest value and the smallest value. The refresh processing for the frame region 20 can thereby be performed without designating the addresses of the frame region 20 from the processing unit 300. In the present embodiment, the rectangle designated by the largest value and the smallest value is the image region 30, and a frame shape obtained by excluding the rectangular image region 30 from the display region 10 is the frame region 20.

Note that, although an exemplary case of setting the rectangular image region 30 in a rectangular display (display region 10) has been described above, the refresh processing of the invention is also applicable to the following cases. For example, an image region 30 having a non-rectangular shape, such as a circle, may be set in a rectangular display, or an image region 30 having a rectangular or non-rectangular shape may be set in a non-rectangular display. For example, in the case of setting a circular image region 30, the center coordinates and the radius of this circle are designated as the image region information. Alternatively, in the case of setting an oval image region, the center coordinates (coordinates of intersecting point of short axis and long axis) of this oval, and the short axis and the long axis (e.g., length and direction of short axis and long axis) thereof are designated as the image region information.

Figure 6:
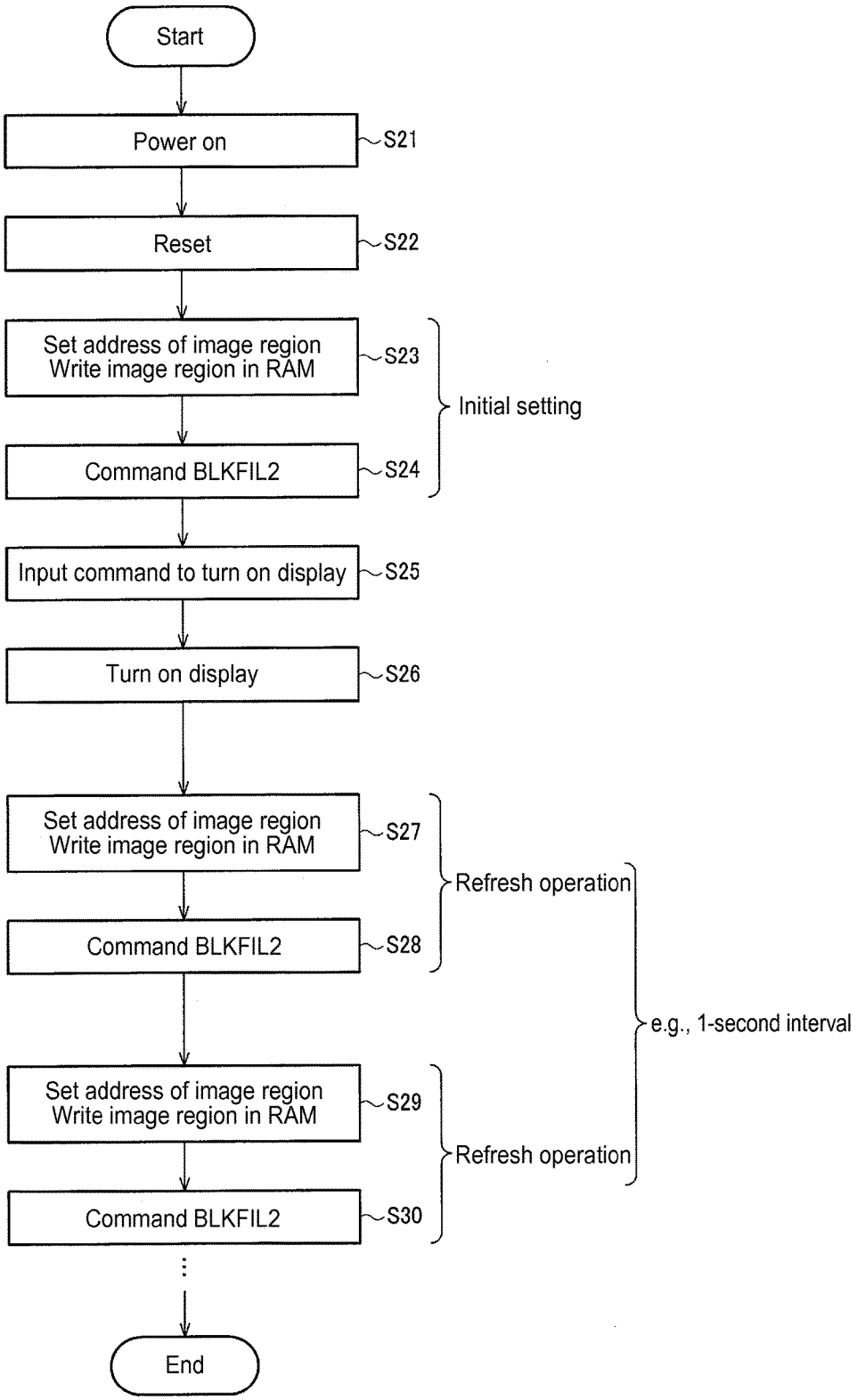
FIG. 6 is a flowchart of a display operation performed by a driver in the present embodiment.

FIG. 6 is a flowchart of a display operation performed by the driver 100. Upon this operation being started, the processing unit 300 supplies power to a power supply terminal of the driver 100 (step S21). Next, the processing unit 300 activates a reset terminal (not shown) of the driver 100 and performs reset (hardware reset) of the driver 100 (step S22).

Next, the processing unit 300 issues an address designation command, and transmits a starting point address and an end point address of a memory region corresponding to the image region 30 to the driver 100. The processing unit 300 issues a command to write the display data, and transmits the display data to the driver 100. The control unit 155 writes the display data in the memory region of the display memory 120 designated by the starting point address and the end point address (step S23).

Next, the processing unit 300 issues a command BLKFIL2 to write the frame region 20. The control unit 155 writes tone data of the frame region 20 in the display memory 120, with the accepting of the command BLKFIL2 as a trigger (step S24).

Next, the processing unit 300 transmits a command to turn on display to the driver 100 (step S25). The control unit 155, upon receiving this command, starts the driving of the display panel and turns on the display (step S26). The content of the display memory 120 written in steps S23 and S24 are displayed on the display panel. That is to say, steps S23 and S24 are initial settings for setting a screen to be first displayed when turning on the display.

Subsequently, the same operations as those in steps S23 and S24 are repeated, and the content of the display memory 120 is rewritten to perform the refresh processing (steps S27 to S30). An interval of the refresh processing is a 1-second interval, for example. This interval may be appropriately set in accordance with a noise environment or the like.

As described above, the command BLKFIL2 is a command that functions as a trigger for writing the frame region 20. That is to say, in the present embodiment, an address setting for the frame region 20 is not necessary since the address setting for the image region 30 can be used, and the writing of the frame region 20 can be achieved by a simple instruction using a trigger only.

Note that, although a description has been given above of an exemplary case of accepting the command BLKFIL2 after accepting the display data and the image region information (starting point address and end point address) and writing the display data in the display memory 120, the invention is not limited thereto. For example, the display data may be accepted after accepting the image region information (starting point address and end point address) and the command BLKFIL2 and writing the tone data of the frame region 20 in the display memory 120. That is to say, the frame region 20 may be written prior to the writing of the display data.

In any case, the tone data of the frame region 20 can be written in the display memory 120 by the command BLKFIL2 serving as a trigger being input after the image region information is set. In the case of writing the frame region 20 prior to the display data as well, the command BLKFIL2 need only be issued after performing the address setting once, and the refresh processing for the frame region 20 is simpler than in the case of dividing the frame region into four regions as in the comparative example.

4. Refresh Processing Using Enable Signal

Figure 7:
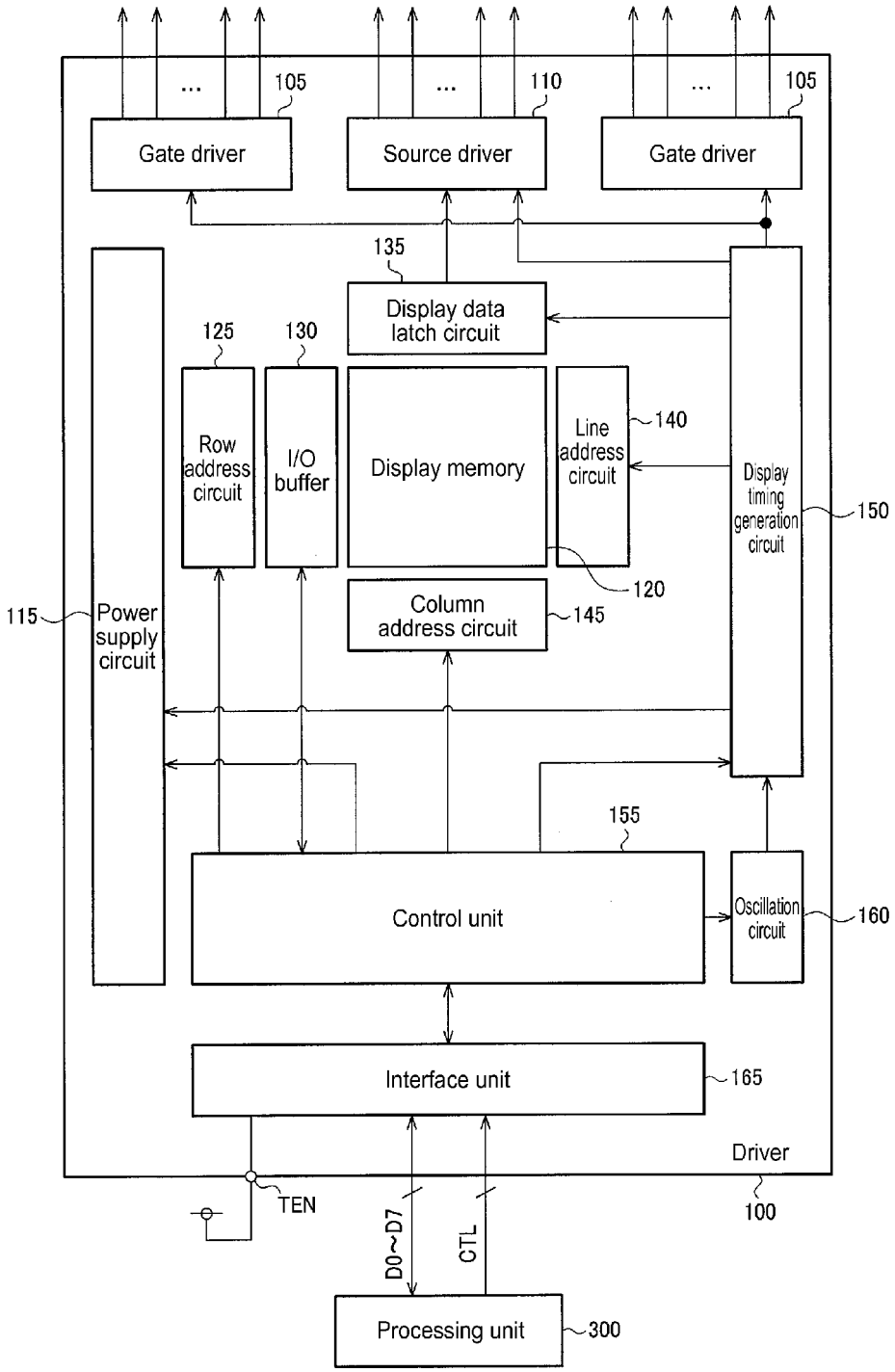
FIG. 7 shows an exemplary configuration of the driver in the case of inputting an enable signal by means of a terminal setting.

Next, the refresh processing for the frame region 20 using an enable signal will be described. FIG. 7 shows an exemplary configuration of the driver 100 in the case of inputting an enable signal by means of a terminal setting.

The driver 100 includes an enable terminal TEN, a gate driver 105, a source driver 110, a power supply circuit 115, a display memory 120, a row address circuit 125, an I/O buffer 130, a display data latch circuit 135, a line address circuit 140, a column address circuit 145, a display timing generation circuit 150, a control unit 155, an oscillator circuit 160, and an interface unit 165. Note that the same constituent elements as those that have already been described above will be given the same reference numerals, and a description thereof will be omitted as appropriate.

The enable terminal TEN is connected to a node of a predetermined voltage level on a circuit board on which the driver 100 is implemented, for example. For example, the enable signal is active (enable) when the enable terminal TEN is connected to an H level node, and the enable signal is inactive (disable) when the enable terminal TEN is connected to an L level node. The voltage level input to the enable terminal TEN is input to the control unit 155 via the interface unit 165.

Note that the enable signal is not limited to a setting on the circuit board, and for example, the enable signal may be input from the processing unit 300 to the enable terminal TEN.

Figure 8:
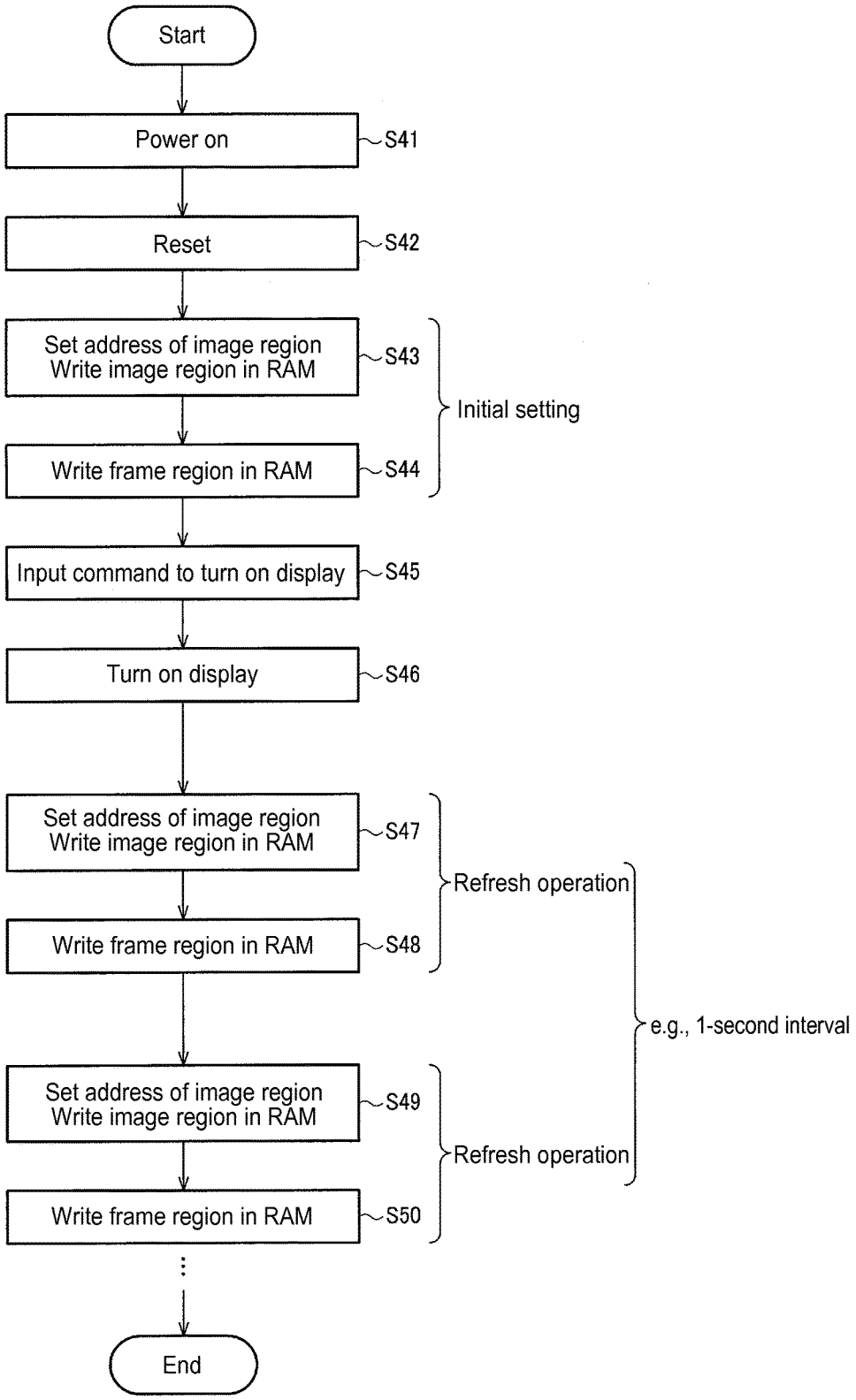
FIG. 8 is a flowchart of a display operation in the case of using the enable signal.

FIG. 8 shows a flowchart of a display operation in the case of using the enable signal. Upon the display operation being started, the processing unit 300 starts power supply to the driver 100 (step S41), and resets the driver 100 (step S42).

Next, the processing unit 300 sets a starting point address and an end point address of a memory region corresponding to the image region 30, and transmits display data to the driver 100. The control unit 155 writes the display data in the display memory 120 (step S43). If the input of the enable terminal TEN is "enable", the control unit 155 writes the tone data of the frame region 20 in the display memory 120 (step S44). That is to say, the control unit 155 starts the refresh processing for the frame region 20 with the end of the processing in step S43 as a trigger.

Next, the processing unit 300 transmits a command to turn on display to the driver 100 (step S45). The control unit 155, upon receiving this command, turns on the display (step S46).

Subsequently, the same operations as those in steps S43 and S44 are repeated, and the content of the display memory 120 is rewritten to perform the refresh processing (steps S47 to S50). An interval of the refresh processing is a 1-second interval, for example.

As described above, in the present embodiment, the tone data of the frame region 20 is written in the display memory 120 at given intervals when the enable signal is active. In the comparative example, the frame region 20 cannot be refreshed only with the enable signal since the addresses of the frame region 20 need to be designated. In contrast, in the present embodiment, the frame region 20 can be refreshed with the enable terminal since the designation of addresses of the image region 30 is used. Furthermore, commands do not need to be regularly issued as a result of using the enable signal, and the driver 100 automatically performs the refresh processing for the frame region 20. Accordingly, the load on the processing unit 300 can be reduced.

In the present embodiment, the refresh processing for the frame region 20 is performed with the end of the writing of the image data in the display memory 120 as a trigger, thereby refreshing the frame region 20 during a period excluding a period of accepting the display data input from the outside (processing unit 300). When regularly performing the refresh processing for the frame region 20 using the enable signal, a timing of this refresh processing may possibly collide with an input timing of the display data. However, according to the present embodiment, this collision can be avoided.

5. Write Processing

As described using FIG. 5, in the present embodiment, the tone data of the frame region 20 is written in the memory region excluding the memory region corresponding to the rectangular image region 30. This processing will now be described in detail.

Figure 9:
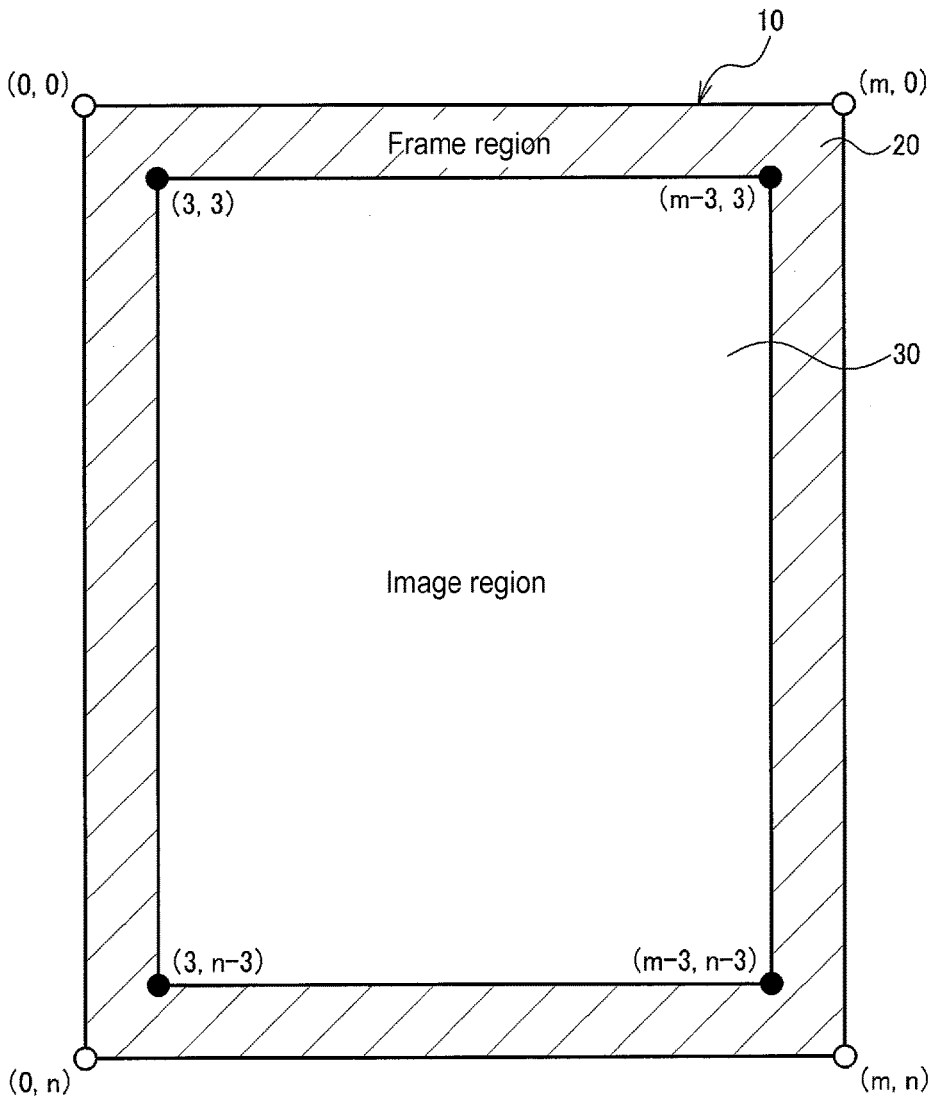
FIG. 9 is a diagram illustrating processing for writing tone data of the frame region.

Assume that, as shown in FIG. 9, the size of the display region 10 is $(m+1)\times(n+1)$ pixels (m and n are natural numbers where $m\geq 2$ and $n\geq 2$), and all widths of the upper, lower, left, and right portions of the frame region 20 are 3 pixels. The starting point and the end point of the image region 30 are (3, 3) and (m−3, n−3), respectively.

In the following description, for the sake of simplification, an address of the display memory 120 corresponding to a pixel will also be expressed by the same value as the coordinates of the pixel. That is to say, a column address and a row address corresponding the pixel at the coordinates (x, y) will be expressed by x and y, respectively.

Figure 10A:
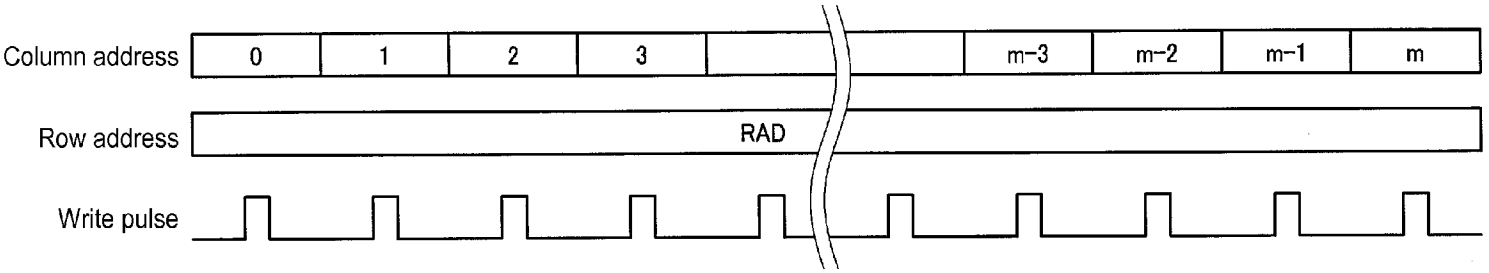
FIGS. 10A and 10B are timing charts of a first technique of the processing for writing the tone data of the frame region.
Figure 10B:
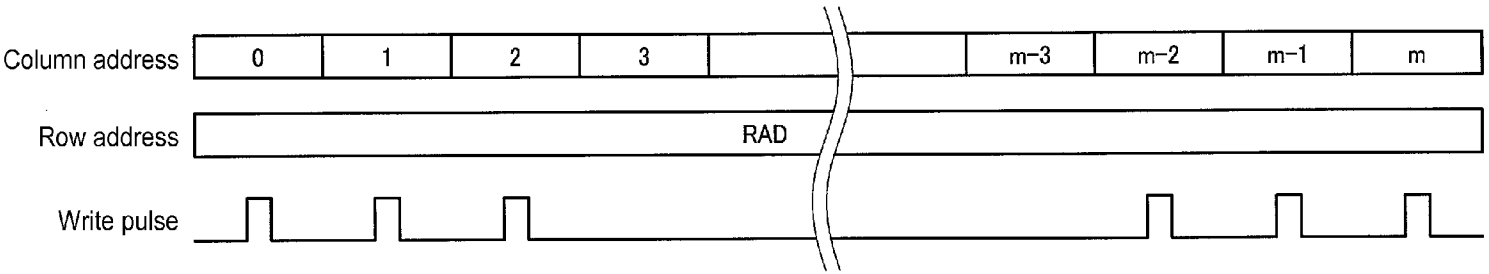

FIGS. 10A and 10B show timing charts of a first technique. In the first technique, 0 to n are sequentially selected as row addresses RAD, column addresses 0 to m are sequentially selected while each row address is selected, and all memory cells in the display memory 120 are selected.

As shown in FIG. 10A, in the upper and lower three rows ($0 \leq RAD < 3$, $n-3 < RAD \leq n$) of the display region 10, a write pulse is set to be active at all of the column addresses 0 to m to write the tone data of the frame region 20. On the other hand, as shown in FIG. 10B, in rows ($3 \leq RAD \leq n-3$) where the image region 30 exists, the write pulse is set to be active only at the column addresses 0 to 2 and m−2 to m corresponding to the frame region 20 to write the tone data of the frame region 20. At the column addresses 3 to m−3 corresponding to the image region 30, the write pulse is not set to be active.

Since the starting point (3, 3) and the end point (m−3, n−3) of the image region 30 correspond respectively to the largest value and the smallest value of the address, it is determined that the addresses which do not belong to this area are the addresses of the frame region 20, and the frame region 20 can be refreshed. In the first technique, the refresh is performed by causing the write pulse to generate only at the addresses of the frame region 20, and accordingly address generation ca be simplified.

Figure 11A:
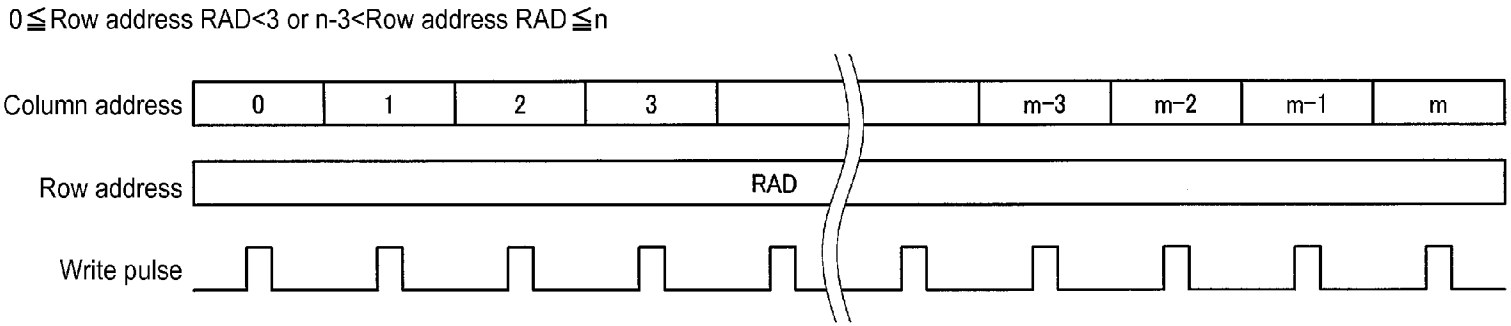
FIGS. 11A and 11B are timing charts of a second technique of the processing for writing the tone data of the frame region.
Figure 11B:
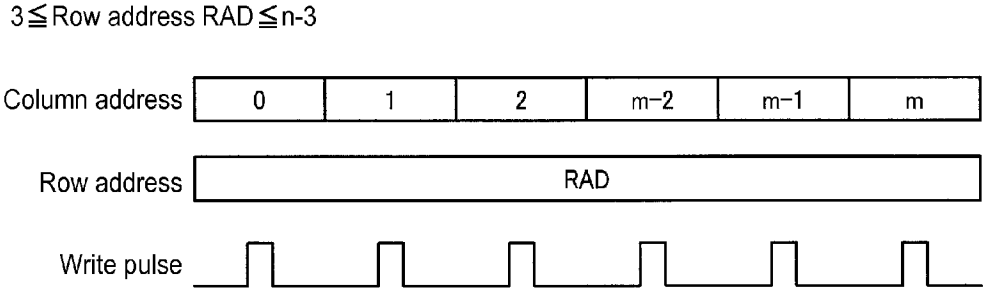

FIGS. 11A and 11B show timing charts of a second technique. In the second technique, the refresh of the frame region 20 is performed by controlling generation of the column address, rather than generation of the write pulse.

As shown in FIG. 11A, in the upper and lower three rows of the display region 10, the write pulse is set to be active at all of the column addresses 0 to m to write the tone data of the frame region 20. On the other hand, as shown in FIG. 11B, in rows where the image region 30 exists, only the column addresses 0 to 2 and m−2 to m corresponding to the frame region 20 are generated, and the column addresses 3 to m−3 corresponding to the image region 30 are not generated. The write pulse is set to be active for all generated column addresses.

In the second technique, only the addresses corresponding to the frame region 20 are generated, and accordingly the time taken for the refresh processing for the frame region 20 can be shortened. If, for example, the display data is to be written after performing the refresh processing for the frame region 20, a wait time can be shortened.

6. Electronic Device

Figure 12:
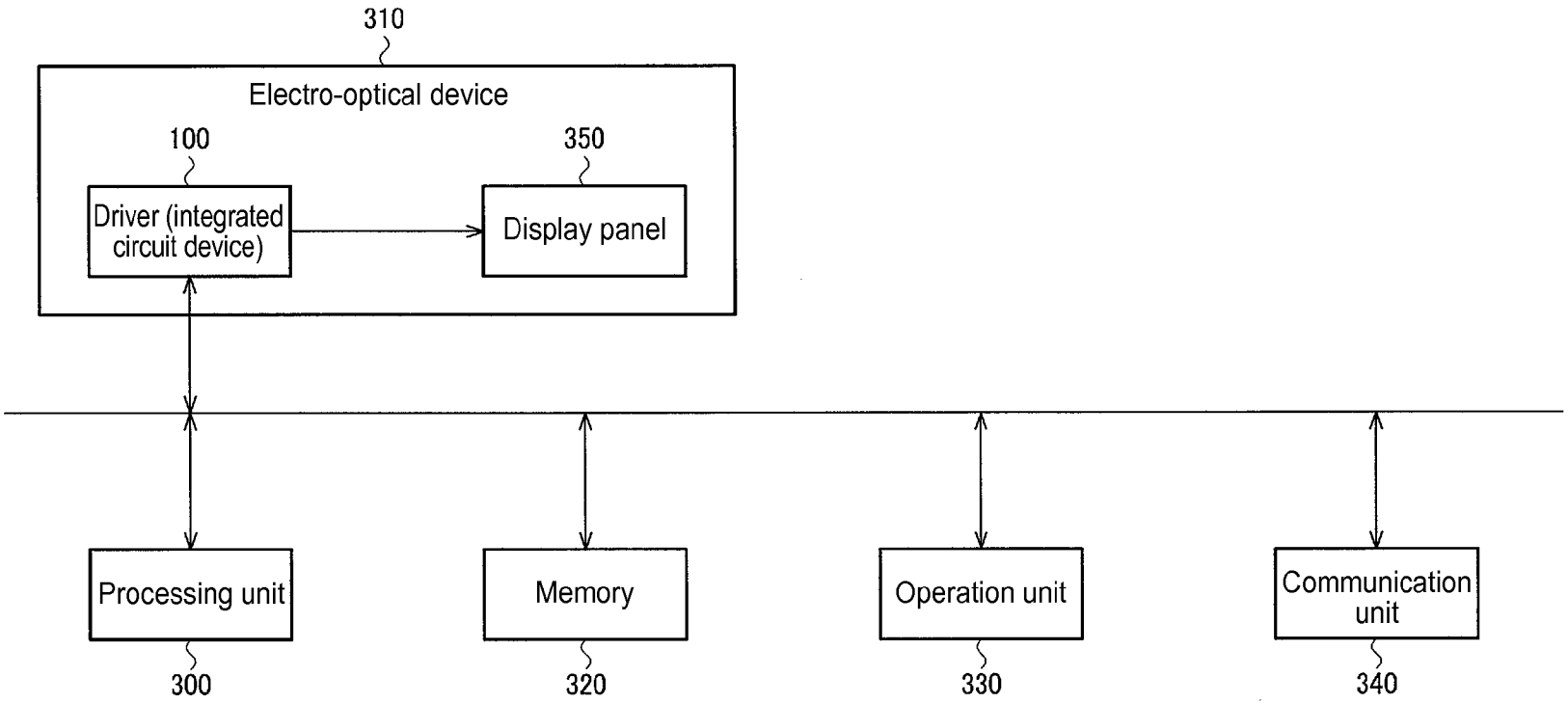
FIG. 12 shows an exemplary configuration of an electronic device.

FIG. 12 shows an exemplary configuration of an electronic device to which the driver 100 in the present embodiment is applicable. The electronic device includes the processing unit 300, an electro-optical device 310, a memory 320, an operation unit 330, and a communication unit 340. The electro-optical device 310 includes the driver 100 and the display panel 350.

As the electronic device, for example, a display device such as a meter in an automobile, display equipment such as a television, mobile equipment such as a smartphone, a potable game machine, a car navigation system, and the like are assumed.

The processing unit 300 is constituted by a processor such as a CPU, an ASIC for image processing, or a DSP, and performs various kinds of processing and control of each part. For example, the processing unit 300 performs processing for reading out image data from the memory 320, or receiving image data via the communication unit 340, and causing the electro-optical device 310 to display this image data. The memory 320 is constituted by a RAM, a ROM, or the like, and functions as a working memory of the processing unit 300 or stores various kinds of data. The operation unit 330 is constituted by a touch panel, buttons, a keyboard, and the like, for example, and accepts operation information from a user. The communication unit 340 is an interface of a USB, a wired LAN, optical communication, a wireless LAN, mobile communication (e.g., 3G or 4G), or the like, and transmits and receives various data and control information to and from an external device.

Note that, although the present embodiment has been described above in detail, those skilled in the art will easily understand that the embodiment can be modified in various manners so as not to substantially depart from the new matter and the effect of the invention. Accordingly, all these modifications are to be encompassed in the scope of the invention. For example, a term that is used at least once together with another term having a broader or the same meaning in the specification or the drawings can be replaced with the other term in any part of the specification or the drawings. All combinations of the present embodiment and the modifications are also encompassed in the scope of the invention. The configurations, operations, and the like of the driver, the display panel, the processing unit, the electro-optical device, the electronic device, and the like are not limited to those described in the present embodiment either, and can be modified in various manners.

The entire disclosure of Japanese Patent Application No. 2014-077739, filed Apr. 4, 2014 and 2015-016340, filed Jan. 30, 2015 are expressly incorporated by reference herein.

What is claimed is:

1. A driver comprising:

a display memory that stores display data; and a control unit that writes the display data in the display memory, wherein the control unit accepts image region information for designating only an image region in which an image corresponding to the display data is to be displayed within a display region of a display panel, and instruction information for giving an instruction to display of a frame region which surrounds the image region in the display region, and performs frame write processing for writing given display data at an address of the display memory corresponding to the frame region generated based on the image region information specifying the coordinates of the image region in advance of frame write processing, without designating the addresses of the frame region prior to the generation of the address corresponding to the frame region from the image region information.

2. The driver according to claim 1, wherein the instruction information is a command that serves as a trigger for the frame write processing, and the control unit performs the frame write processing when accepting the command.

3. The driver according to claim 1, wherein the image region is a rectangle, and the image region information is information for designating two diagonal points of the rectangle.

4. The driver according to claim 3, wherein the image region information is information for designating, as information of the two points, a starting point address and an end point address of a memory region of the display memory corresponding to the rectangle, and the control unit writes the given display data in a memory region excluding the memory region designated by the starting point address and the end point address.

5. The driver according to claim 1, further comprising a drive circuit that drives the display panel based on the display data and the given display data that are written in the display memory, and displays the image and the frame region in the display region.

6. The driver according to claim 1, wherein the given display data is data stored within the driver, and the control unit performs the frame write processing, using the given display data stored within the driver.

7. A driver comprising:

a display memory that stores display data; and a control unit that writes the display data in the display memory, wherein the control unit accepts image region information for designating an image region in which an image corresponding to the display data is to be displayed within a display region of a display panel, and instruction information for giving an instruction to display of a frame region which surrounds the image region in the display region, and performs frame write processing for writing given display data at an address of the display memory corresponding to the frame region, based on the image region information; and an enable terminal, wherein the instruction information is an enable signal that is input from the enable terminal, and the control unit performs the frame write processing at a given interval when the enable signal is active.

8. The driver according to claim 7, wherein the control unit performs the frame write processing in a period excluding a period of accepting the display data that is input from outside.

9. A driver comprising:

a display memory that stores display data; and a control unit that writes the display data in the display memory, wherein the control unit accepts image region information for designating an image region in which an image corresponding to the display data is to be displayed within a display region of a display panel, and instruction information for giving an instruction to display of a frame region which surrounds the image region in the display region, and performs frame write processing for writing given display data at an address of the display memory corresponding to the frame region, based on the image region information, wherein the instruction information is a command that serves as a trigger for the frame write processing, and the control unit performs the frame write processing when accepting the command, and wherein the control unit accepts the display data and the image region information, writes the display data in the display memory, accepts the command after writing the display data, and performs the frame write processing.

10. A driver comprising:

a display memory that stores display data; and a control unit that writes the display data in the display memory, wherein the control unit accepts image region information for designating an image region in which an image corresponding to the display data is to be displayed within a display region of a display panel, and instruction information for giving an instruction to display of a frame region which surrounds the image region in the display region, and performs frame write processing for writing given display data at an address of the display memory corresponding to the frame region, based on the image region information, wherein the instruction information is a command that serves as a trigger for the frame write processing, and the control unit performs the frame write processing when accepting the command, and wherein the control unit accepts the image region information and the command, performs the frame write processing, accepts the display data after performing the frame write processing, and writes the display data in the display memory.

11. An electro-optical device comprising:

the driver according to claim 1; and the display panel.

12. An electronic device comprising the driver according to claim 1.

* * * * *